United States Patent [19]

Witty et al.

[11] 3,980,227

[45] Sept. 14, 1976

[54] ADJUSTABLE ROTATOR FOR FLUID SAMPLES

[75] Inventors: Michael E. Witty, El Toro; Dennis F. Shine, Huntington Beach; Dennis J. Reisdorf, Santa Ana, all of Calif.

[73] Assignee: Baxter Travenol Laboratories, Inc., Deerfield, Ill.

[22] Filed: Nov. 8, 1974

[21] Appl. No.: 522,201

[52] U.S. Cl. ..... 233/23 R; 233/26; 248/23

[51] Int. Cl.[2] ..... B04B 9/10

[58] Field of Search ..... 233/1 B, 1 R, 23 R, 233/24, 25, 26, 27; 211/74, 77; 127/19; 220/23.4, 23.8; 23/259; 64/30 R

[56] References Cited

UNITED STATES PATENTS

| | | | |
|---|---|---|---|
| 489,643 | 1/1893 | Steffen | 127/19 |
| 3,021,001 | 2/1962 | Donofrio | 220/23.4 |
| 3,163,404 | 12/1964 | Kraft et al. | 233/26 X |
| 3,314,257 | 4/1967 | Fosler et al. | 64/30 R |
| 3,339,836 | 9/1967 | Mitchell et al. | 233/23 R |
| 3,531,950 | 10/1970 | Foerstner | 64/30 R |
| 3,709,429 | 1/1973 | McKenzie | 211/74 X |
| 3,712,535 | 1/1973 | Genese et al. | 233/26 |

FOREIGN PATENTS OR APPLICATIONS

| | | | |
|---|---|---|---|
| 606,945 | 3/1926 | France | 233/26 |
| 993,500 | 7/1951 | France | 233/26 |

*Primary Examiner*—George H. Krizmanich
*Attorney, Agent, or Firm*—Louis Altman; Lawrence W. Flynn; Max D. Hensley

[57] ABSTRACT

Samples which are to be processed or analyzed in the laboratory are placed in small vials or cuvettes. Groups of cuvettes are placed in arcuate carriers, which are then mounted about the periphery of a rotator head. The rotator head has two selectable motions. It can rotate at a higher speed on a vertical axis for an automatically timed period, thereby subjecting the samples to mild centrifugal settling or sedimentation, or it can rotate at a lower speed about an inclined axis, thereby subjecting the sample to mild agitation or mixing.

7 Claims, 10 Drawing Figures

FIG. 1.
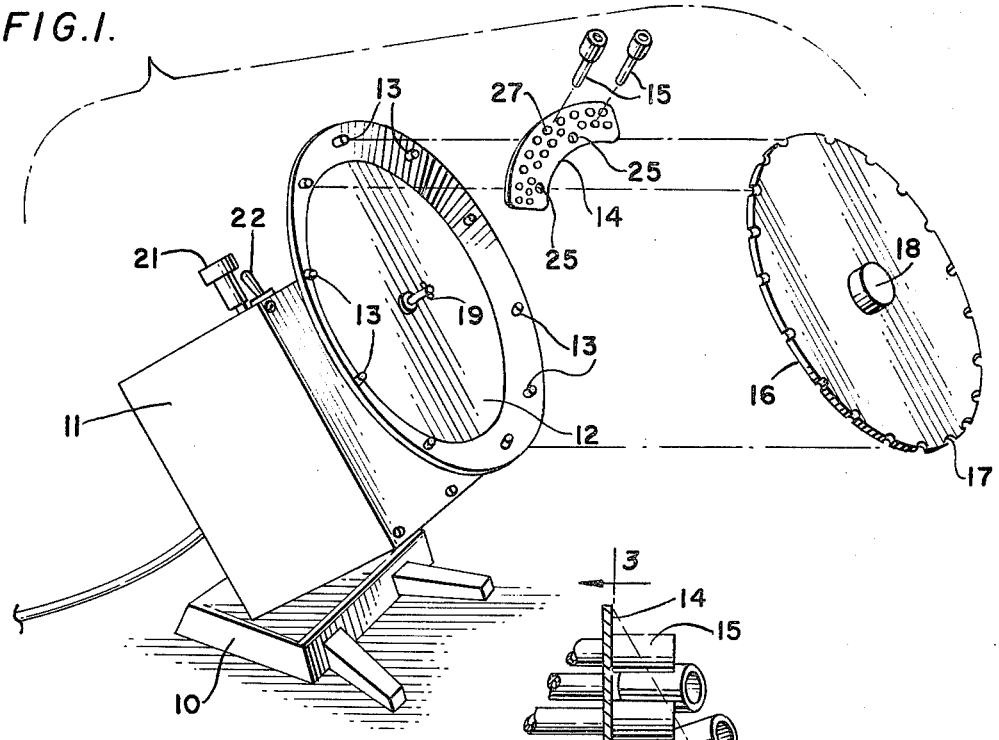
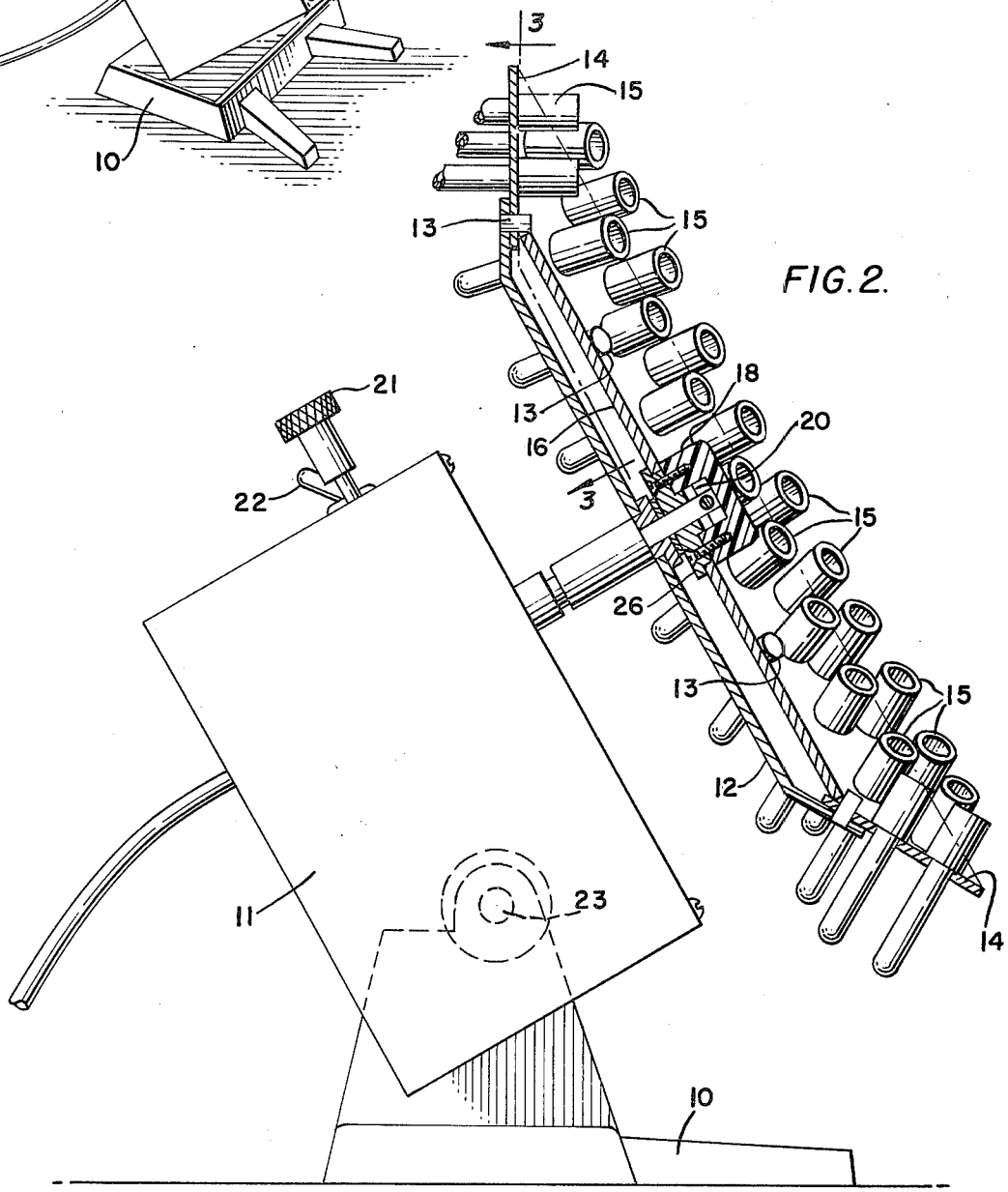
FIG. 2.

ADJUSTABLE ROTATOR FOR FLUID SAMPLES

BRIEF SUMMARY

A primary object of the invention is to provide an improved rotator for mildly agitating or mildly centrifuging a plurality of fluid samples in the laboratory.

The rotator is provided with a head having an annular flange with retaining pins on which are hung arcuate carriers. These carriers carry a series of cuvettes which hold the liquid samples. The provision whereby the carriers can be loaded with cuvettes elsewhere than at the rotator is a desirable feature.

Both cuvettes and arcuate carriers can be single use disposable type.

The arcuate carriers are held securely in place on the rotator head by means of a clamping plate which is locked in place by the turning of a locking knob.

The rotator can operate with the rotator head spinning at relatively high speed in a horizontal plane or in low speed in a plane tilted to near vertical. In the first position mild centrifuging is achieved, in the second position mild agitation is achieved.

A unitary blister formed closure which can seal as many cuvettes as happen to be in an arcuate carrier is disclosed.

In one embodiment of the invention, two carrying handles are provided. These approximately straddle the center of gravity of the rotator, making it easy to carry the rotator, for example, from table to table. The handles also act as limit stops, restricting the tilting of the rotator head to a range of less than 90°, and preferably about 75°, between horizontal and near vertical.

Said embodiment is also provided with interlocks preventing operation of the rotator at high speed when the rotator head is in the near vertical position.

An automatic timed cycle is provided whereby when a push button is actuated, the rotator will run at high speed for, for example, one minute, after which it will automatically shut off. A counter is actuated by the push button, and indicates the number of times the one minute cycle of high speed rotation has been put in motion.

DRAWINGS

FIG. 1 is an exploded perspective view of a motor housing, a rotator head driven thereby, an arcuate cuvette carrier, two cuvettes for holding the fluid samples and a clamping plate.

FIG. 2 shows the rotator of FIG. 1, partly in cross section, loaded with cuvettes, with the rotator head set in the slanted position for mild agitation or mixing.

DETAILED DESCRIPTION

In various kinds of laboratories it is often necessary to manipulate large numbers of fluid samples to achieve settling or sedimentation, or to agitate or mix samples. Settling may, for example, be used in the separation of a two phase solid-liquid system as in the separation of precipitates from solutions or the collection of whole blood cells in the clinical laboratory. Agitation may, for example, be used to dissolve solids in liquids, to prevent fluid samples from separating, to react together chemicals or biologicals and to wash precipitated matter. Agitation must often be mild, to prevent the formation of froth or damage to, for example, whole blood cells.

The herein described apparatus facilitates the performance of functions set forth above, with minimum burden to the user.

One embodiment of the instant invention is shown in FIG. 1.

Figure 5:
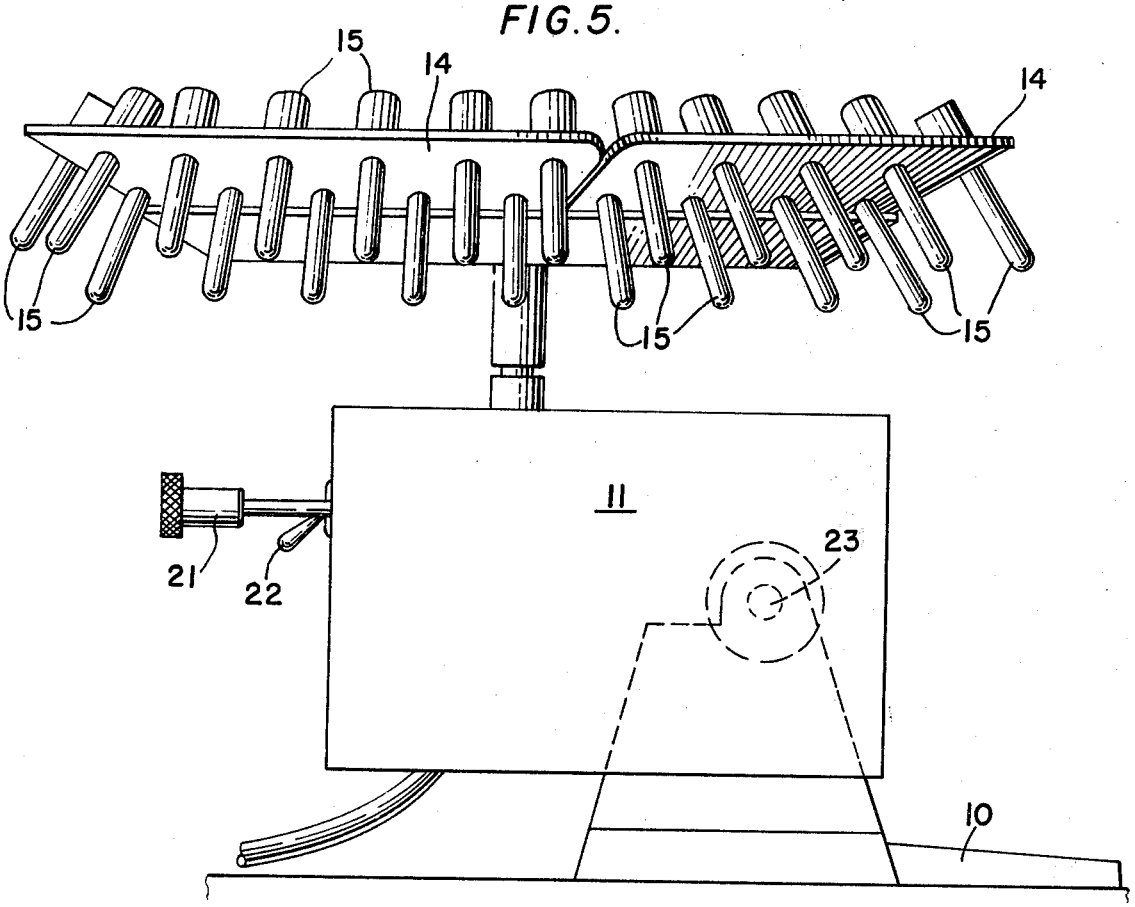
FIG. 5 is a view of the rotator with the rotator head set in the position for mild centrifugal settling or sedimentation.

A motor drive unit 11 having an on-off switch 22 and a motor speed control knob 21 is supported on base 10 by means of a pivot 23. The pivot permits the motor to be swung in a vertical plane so that the motor shaft is tilted to the horizontal, as shown in FIG. 2, or is vertical, as shown in FIG. 5.

Figure 3:
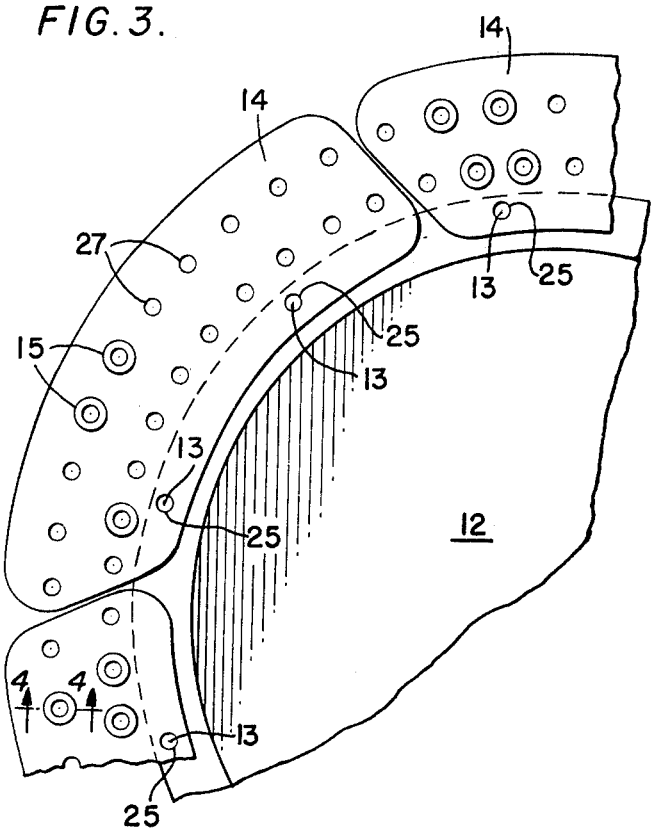
FIG. 3 is a view along section line 3—3 of FIG. 2, showing individual carriers, each partly loaded with cuvettes.
Figure 4:
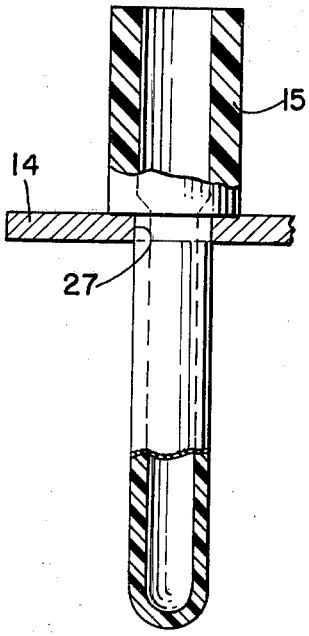
FIG. 4 is a view along section line 4—4 of FIG. 3, showing the construction of a cuvette.

Mounted on the shaft of the motor drive unit 11 is a rotator head 12. As seen from FIGS. 1 and 2, the rotator head has a disk, from the edge of which extends a flnage bent upwardly at about 20° – 40 ° and preferably about 30° from the plane of the disk. The inner face of the flange is provided with a series of equally-spaced retaining pins 13. A series (or a single one) of arcuate carriers 14 can be hung on the retaining pins 13 since each arcuate carrier has mounting holes 25 which match the retaining pins. The arcuate carriers 14 are provided with a series of socket holes 27, each of which can support a cuvette 15. The shape of a cuvette 15 is best seen in the partially cross sectioned view of FIG. 4. A cuvette is a miniaturized test tube used for the small samples often used in clinical laboratories. It will be understood the micro size shown is illustrative, and changes of scale to accommodate the size of samples are to be taken for granted.

In order to clamp the arcuate carriers 14 onto the rotator head 12 and the retaining pins 13, there is provided a clamping plate 16, which has a series of equally-spaced peripheral notches 17. The size of the clamping plate 16 and the spacing of the notches 17 is such that when the clamping plate 16 is applied to the rotator head 12, the notches 17 will fit loosely against the retaining pins 13, as seen in the cross section of FIG. 2. The clamping plate 16 is used to hold the arcuate carriers 14 securely onto the rotator head 12, since it makes it impossible for the mounting holes 25 of the arcuate carriers 14 to become detached from the retaining pins 13 during rotation.

In FIG. 1 there are shown ten equispaced retaining pins 13 and twice as many notches 17. The increase in the number of notches over the number of retaining pins renders the assembling somewhat quicker as the matching of notch to retaining pin requires less fiddling.

The cuvettes 15 have a snug fit in the socket holes 27 of the arcuate carriers 14. Accordingly, an arcuate carrier and its load of cuvettes can be handled as a unit and can be readily loaded on the rotator head 12 when in the horizontal position, as shown in FIG. 5, or when slightly tilted toward the operator. The friction of the pivot is sufficient to maintain the tilt established by the operator. In that position, the arcuate carriers 14 can be hung on the retaining pins 13 and will not fall off because of friction between retaining pins 13 and the mounting holes 25 of the arcuate carriers 14. When as many arcuate carriers and cuvettes have been mounted on the rotator head as is desired, the mounting is made secure by fastening the clamping plate 16 to the rotator head 12. The fastening knob 18 is rotatable with respect to the clamping plate 16 but is captive thereto, because the fastening knob 18 is attached to collar 26, as best seen in FIG. 2. On the inner bore of the fastening knob 18 and the collar 26 is provided a longitudinal slot and a helical internal camming surface 20, said slot and said cam adapted to receive cross pin 19 (FIGS. 1 and 2). Thus, when the slot and bore of the collar 26 and knob 18 are threaded over the shaft of the motor drive unit 11 and its cross pin 19, the clamping plate 16 will first clamp the arcuate carriers 14 and engage the retaining pins 13 and then the knob can be rotated, without rotation of the clamping plate 16, to engage the cross pin 19 with the helical internal camming surface 20 to lock the parts together.

The use of arcuate carriers 14 simplifies the loading of the rotator, for all the loading need not be done directly at the rotator. Further, if the cuvettes 15 are loaded elsewhere, the arcuate carriers 14 form convenient supports for the cuvettes 15. Both cuvettes 15 and arcuate carriers 14 can be single use disposable items, in keeping with the trend in clinical laboratory practice, in which case the cuvettes can be made of a plastic such as polyethylene or polypropylene and the arcuate carriers can be made of a cellulosic material such as cardboard.

Cardboard has the additional advantage as the material for construction of the arcuate carriers in that it can be written upon with pen or pencil for the convenient entry of laboratory notations. Furthermore, it has the desired combination of flexibility to accommodate the curvature of the rotator head flange and yet has sufficient rigidity to be self supporting for retaining the cuvettes in any position.

Under some uses, it may be advisable to cover the specimens in the cuvettes, to prevent, for example, spillage, contamination, oxidation or drying. Rather than using stoppers or closures individual to each cuvette 15, a "blister-formed" type of closure, as shown in FIGS. 6 to 8 is advantageous.

Figure 6:
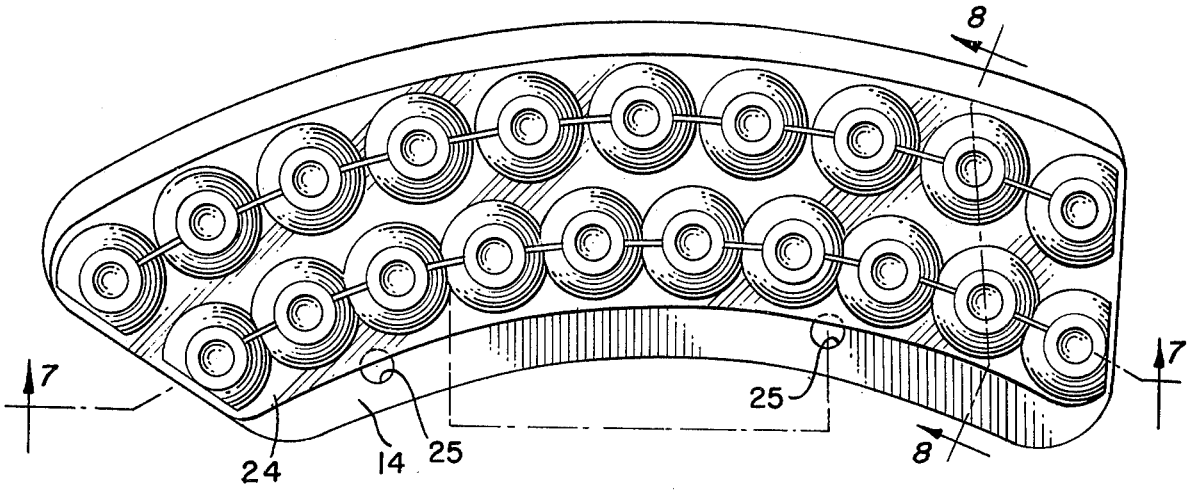
FIG. 6 is a top view of a single cuvette carrier, loaded with cuvettes, and having a unitary cover snapped over the cuvette.
Figure 7:
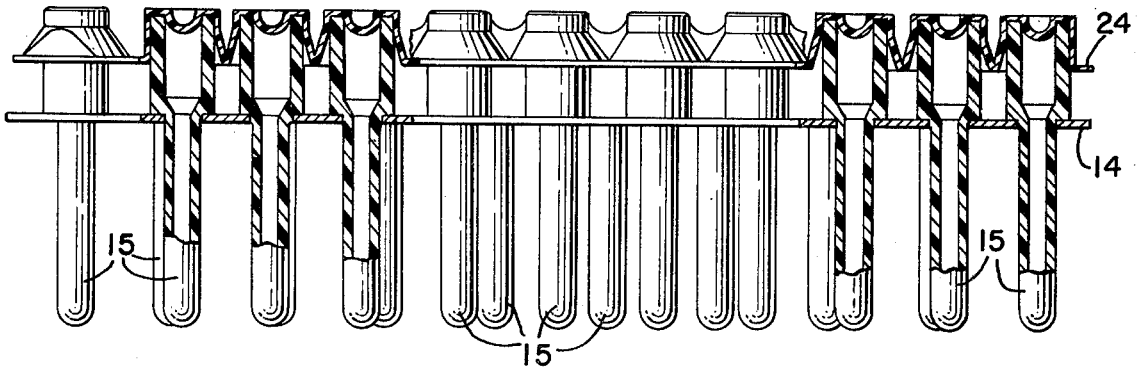
FIG. 7 is a side view, partly in cross section, along section line 7—7 of FIG. 6.
Figure 8:
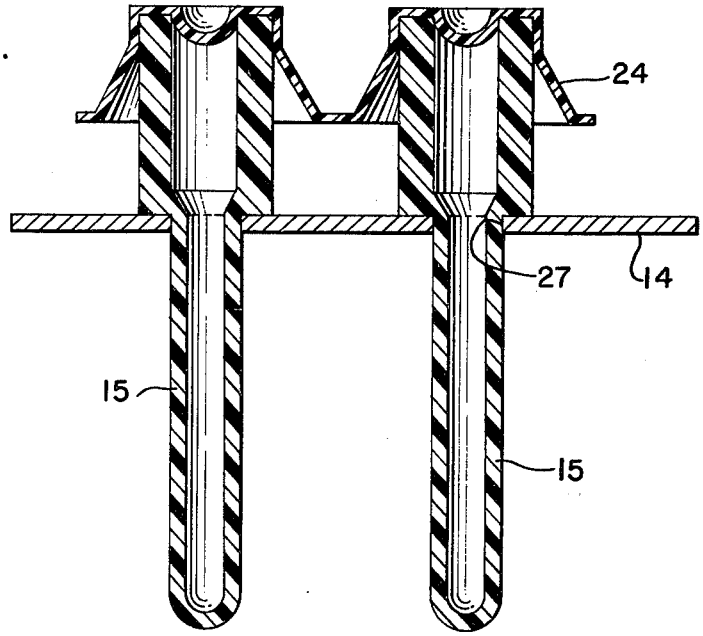
FIG. 8 is a detailed cross section along section line 8—8 of FIG. 6.

As seen in FIGS. 6 to 8, the unitary closure 24 is a thin sheet of plastic material such as polystyrene formed, as, for example, by vacuum molding, so as to have the shape illustrated. The shape is such that the mouth ends of the cuvettes 15 are snugly engaged by the closure 24 to thereby form a shrink proof seal.

The combination of the arcuate carrier and its corresponding cover provides unique handling and storage advantages for the disposable parts of the invention in that up to 20 cuvettes can be stored or moved about as a unit in a single carrier which requires only one cover.

It will be noted that the two rows of cuvettes 15 are mounted in an arcuate carrier 14 in a staggered manner. This makes it possible for the laboratory technologist to readily observe either row of cuvettes from one side of the arcuate carrier 14.

In the embodiment shown in FIGS. 1 to 8, a plurality of five arcuate carriers 14 can be placed on rotator head 12. Since each carrier holds 20 cuvettes, it will be seen that up to 100 samples can be rotated at one time with the rotator of this invention.

Figure 9:
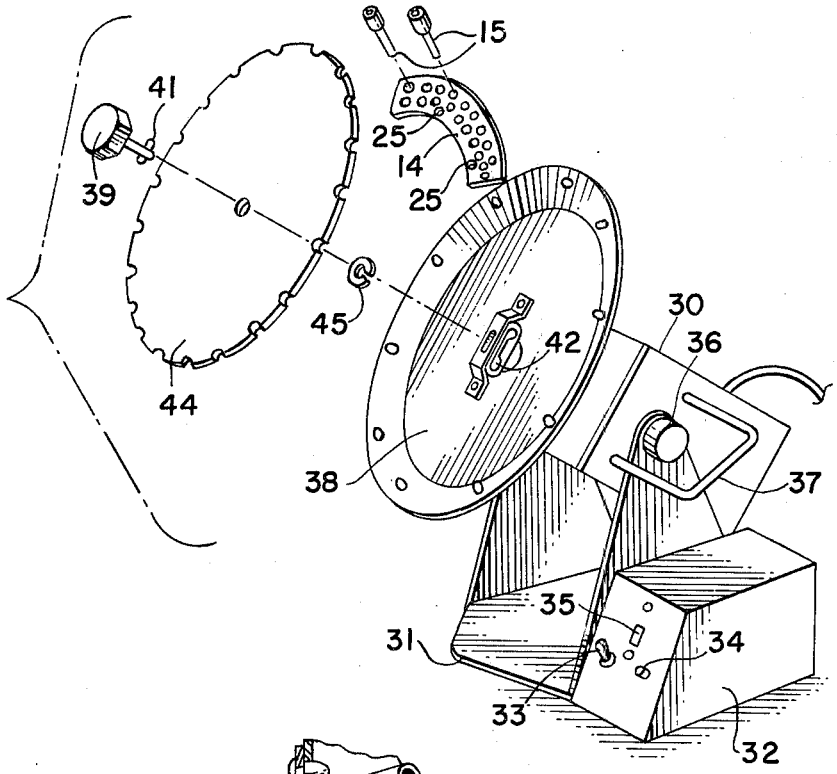
FIG. 9 shows a modification of the rotator of FIG. 1, having a preferred fastener for securing the clamping plate onto the rotator head.
Figure 10:
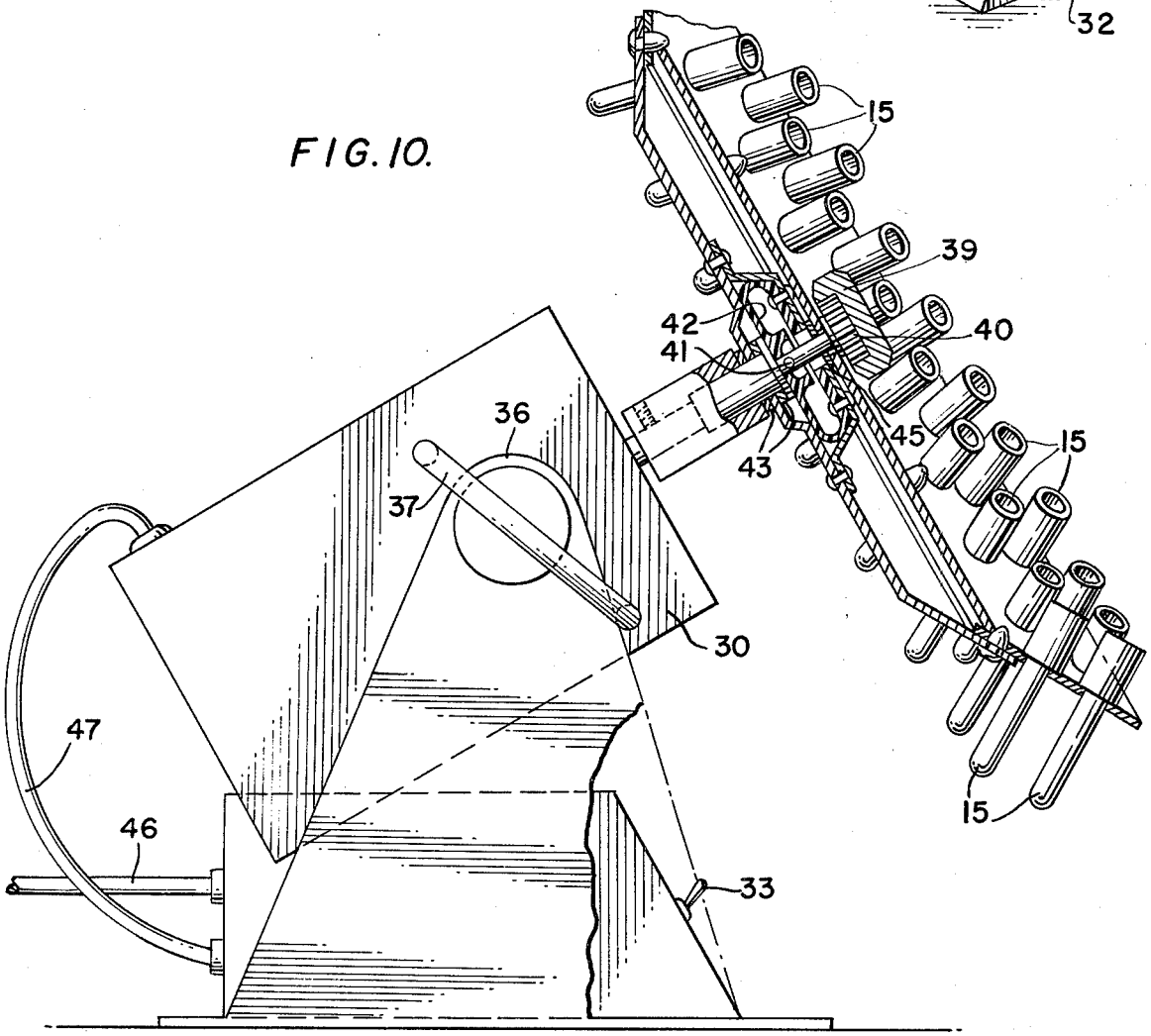
FIG. 10 is a side view of the rotator of FIG. 9, partly in cross section, showing the preferred fastening means for the rotator head and showing the manner by which the head is fastened to the drive shaft, permitting frictionally controlled rotary slippage between the drive shaft and the rotator head.

A second and preferred embodiment of the instant invention is seen in FIGS. 9 and 10.

This second embodiment is generally similar to that discussed above, and common features will not be discussed below.

A motor drive unit 30 is tiltably mounted on base 31 by means of two trunnions 36. The rotator head 38 is generally used so that the head is operated either in a horizontal plane or in a plane tilted from the vertical, as shown in FIG. 10. Accordingly, the handle 37 and a similar one (not seeable in the view of FIG. 10 but located on the other side of the motor drive unit 30) are each provided with legs joined by a yoke, with the legs so located on the motor drive unit as to act as limit stops, preventing pitching of the rotator head beyond the just mentioned horizontal and tilted from vertical positions. The yokes of handles 37 provide a convenient means for carrying the rotator, as they fit a person's hands and they approximately straddle the center of gravity of the rotator, thus avoiding the feeling of holding an awkward burden.

Two speeds of rotation, such as, for example, 100 rpm (high speed) and 6 rpm (low speed) are provided. The high speed is used only when the rotator head 38 is in the horizontal position, while the low speed is used only when the rotator head 38 is tilted from the vertical.

The speed is selected by operating the three position toggle switch 33 of control box 32. The middle position of the switch is "off", the up position of the switch is "high" and the down position of the switch is "low".

In order to prevent the operation of the rotator head 38 at the wrong speed, electrical interlocks, responsive to the position of the motor drive unit 30, are provided to prevent the actuation of the high speed circuit or the low speed circuit when the rotator head 38 is in the wrong position for the speed selected at the three position toggle switch 33.

In some kinds of sedimentation studies, time of sedimentation is selected as an independent variable, and must be accurately measured. Accordingly, the high speed circuit of the motor drive unit is provided with a 1-minute timer which cuts off the rotation after 1 minute of operation. Further, for high speed operation, the high speed start push buttom 34 must be actuated. The high speed start push button 34 is connected to a high speed start cycles counter 35. Thus, after high speed operation has been selected at the three position toggle switch 33, nothing will happen unless the rotator head 38 is put into the horizontal plane. Then, when the high speed start push button 34 is actuated, the rotator head 38 will be rotated at high speed for one minute before it automatically stops. Furthermore, the high speed start cycles counter 35 is advanced one count. In order to reset the counter 35 to zero, the three position toggle switch is put in the low speed position and the rotator head 38 is tilted out of the vertical plane, thereby tripping the reset mechanism on the high speed start cycles counter.

The means for fastening the clamping plate 44 against the rotator head 38 includes locking knob 39 (which is retained captive on clamping plate 44 by split washer 45) which engages, in quater-turn lock mode, with locking socket 42. In order to render the locking knob 39 easier to operate, the knob 39 is an enlarged addition to a small commercial knob 40.

The rotator head is not keyed directly to the shaft of the motor drive unit 30, but is rather carried on it by friction means which permit the operator to turn the rotator head by hand during the loading or unloading operation. The friction is provided by two friction washers 43 which are preferably of leather construction.

Electric power for operation of the rotator is supplied via a main power cord 46 leading to control box 32 and therefrom to motor drive unit 30 via control cord 47.

The above description is intended to be exemplary rather than limitive of the scope of the following claims.

What is claimed is:

1. In a rotator for agitating or centrifuging liquid samples, the combination of a shaft, means to rotate said shaft about its axis, a circular disk concentrically mounted on said shaft so as to rotate with said shaft, a concentric flared annular flange extending from the edge of said disk, a series of retaining pins spaced along said flange, said retaining pins being located so that at least some are equally spaced from each other and equally spaced from the said axis, arcuate carriers hung on said retaining pins, each of said carriers having at least two mounting holes so spaced as to match the spacing of said at least some of said retaining pins, said carriers when hung on said retaining pins extending outboard of said flared flange, and a series of holes in the outboard portion of said carriers, said holes adapted to receive and support cuvettes for holding liquid samples.

2. The subject matter of claim 1, in combination with a clamping plate for preventing disengagement between the mounting holes in the arcuate carriers and the retaining pins, said clamping plate having means to clamp said plate against the disk portion of said rotator head, with the outer edge of said clamping plate pressing against the portion of said arcuate carriers inboard of the retaining pins.

3. The subject matter of claim 2, in which the said retaining pins are equally spaced from said axis and in which the clamping plate is circular, concentric with said axis, and of a radius substantially equal to the radius on which said retaining pins are located, said clamping plate having a series of notches spaced around its periphery, said notches matching and fitting said retaining pins so that said clamping plate can rest on said rotator head within said retaining pins and partially surround said pins while clamping said arcuate carriers to the rotator head.

4. The subject matter of claim 3, in which the said clamping plate is provided with a second series of notches, additional to said aforementioned series of notches, said second series of notches also matching and fitting said retaining pins in the same manner as do the aforementioned series of notches, and each notch of said second series of notches being spaced on the periphery of said clamping disk the same angular distance from the corresponding notch of the aforementioned series of notches.

5. In a rotator for agitating or centrifuging liquid samples, the combination of a base adapted to rest on a supporting surface, support trunnions, arms extending from said base to said support trunnions, a motor drive unit pivotally supported by said support trunnions, the axis of said pivoting being parallel to the plane of the supporting surface, a rotator head driven by said motor drive unit about a second axis perpendicular to the aforementioned axis, said rotator head having means to support a series of cuvettes for holding liquid samples, a pair of handles mounted on opposite sides of said motor drive unit, each handle having a U shape with two legs joined by a yoke, the handles being positioned on said motor mount so that they approximately straddle the center of gravity of the rotator, thereby facilitating carrying of the rotator, and also so that they straddle the said arms in such manner that the legs of said handles, by abutting against said arms, limit the pivoting motion of said motor drive unit between two extremes, over a range of less that 90°, in which the rotator head is horizontal in the first extreme position, and in which the rotator head is tilted away from the horizontal in the other extreme position.

6. The subject matter of claim 5 in which the range of motion is about 75°.

7. In a rotator for agitating or centrifuging liquid samples, the combination of a rotor head a motor drive unit having an output shaft for rotating said rotator head, said rotator head being mounted directly on the output shaft of said motor drive unit and said rotator head adapted to support cuvettes containing liquid samples, means to tilt said motor drive unit into either of two positions, in one of which the rotator head is horizontal, and in the other of which the rotator head is tilted to near vertical, separate means to select the speed of rotation of said motor drive unit for either fast or slow rotation and interlock means preventing the operation of said motor drive unit at high speed when the motor drive unit is not tilted so as to place the rotator head in the horizontal position.

* * * * *